United States Patent [19]

Sakazume et al.

[11] 4,111,000

[45] Sep. 5, 1978

[54] ROOM AIR CONDITIONER

[75] Inventors: Akio Sakazume; Hiroshi Iwata; Hiroo Nakamura, all of Yokohama; Hiroyuki Ogawa, Tochigi; Susumu Kashiwazaki, Utsunomiya; Saneaki Nakao, Tochigi, all of Japan

[73] Assignee: Hitachi, Ltd., Japan

[21] Appl. No.: 759,413

[22] Filed: Jan. 14, 1977

[30] Foreign Application Priority Data

Jan. 19, 1976 [JP] Japan ..... 51-4008

[51] Int. Cl.[2] ..... F25D 23/12; F25D 17/06

[52] U.S. Cl. ..... 62/262; 62/427

[58] Field of Search ..... 62/262, 263, 427, 237

[56] References Cited

U.S. PATENT DOCUMENTS

| | | | |
|---|---|---|---|
| 2,667,765 | 2/1954 | Harris et al. | 62/262 |
| 2,851,866 | 9/1958 | Rose | 62/427 |
| 3,416,329 | 12/1968 | Thomas | 62/262 |
| 3,792,593 | 2/1974 | Loos et al. | 62/427 |
| 3,805,541 | 4/1974 | Hosoda et al. | 62/262 |
| 3,898,865 | 8/1975 | Stewart et al. | 62/262 |

*Primary Examiner*—Lloyd L. King
*Attorney, Agent, or Firm*—Craig & Antonelli

[57] ABSTRACT

A room air conditioner in which the interior of a cabinet is divided into an indoor portion and an outdoor portion by a partition plate having a non-vertical section, and a fan motor is supported in the outdoor portion in such a manner that its rotary shaft is disposed perpendicular to the bottom of the cabinet and penetrates the partition plate at one end thereof to extend into the indoor portion. A first centrifugal fan is mounted at one end of the rotary shaft of the fan motor while a second Silocco fan is mounted at the other end thereof disposed in the outdoor portion. An indoor heat exchanger is disposed in spaced juxtaposed relation to a suction opening formed in the front of the indoor portion so that the air inside a room is drawn by suction through the indoor suction opening and caused to pass through the indoor heat exchanger by means of the first Silocco fan which exhausts air into the room through an indoor exhaust port, and an outdoor heat exchanger is disposed in spaced juxtaposed relation to a suction opening formed in the rear of the outdoor portion so that the air outside the room is drawn by suction through the outdoor suction opening and caused to pass through the outdoor heat exchanger by means of the second centrifugal fan which exhausts air outside the room through an outdour exhaust port. The room air conditioner has a greatly reduced thickness as compared with the same type of air conditioners of the prior art.

7 Claims, 8 Drawing Figures

PRIOR ART

ROOM AIR CONDITIONER

BACKGROUND OF THE INVENTION

This invention relates to room air conditioners, and more particularly it is concerned with a room air conditioner of the vertical type having a compact overall size.

A conventional air conditioner of the vertical type will be described with reference to the drawings before describing the present invention to particularly point out the characterizing features thereof. FIG. 1 is a sectional side view of a conventional air conditioner of the vertical type which has hitherto been in use, and FIG. 2 is a sectional view taken along the line II—II of FIG. 1. As shown in these figures, the room air conditioner includes a cabinet 1 the interior of which is divided into an indoor portion 10 and an outdoor portion 11 by a partition plate 12 secured to a bottom 9 of the cabinet 1. A motor 5 is supported on a side of the partition plate 12 which faces the outdoor portion 11 of the cabinet 1 and includes a rotary shaft 5*a* which is disposed horizontally (i.e. parallel to the bottom 9), a portion of the rotary shaft 5*a* penetrating the partition plate 12 and extending into the indoor portion 10.

Mounted in the indoor portion 10 of the cabinet 1 are a centrifugal fan 3 secured to the rotary shaft 5*a*, a spiral casing 4 secured to the partition plate 12 and disposed in enclosing relation to the Silocco fan 3, and an indoor heat exchanger 2 located adjacent the spiral casing 4 on a side thereof opposite the Silocco fan 3. Housed in the outdoor portion 11 of the cabinet 1 are a propeller fan 6 secured to the rotary shaft 5*a* of the fan motor 5, an outdoor heat exchanger 7 disposed in spaced juxtaposed relation to the propeller fan 6, a cover 15 interconnecting the propeller fan 6 to the outdoor heat exchanger 7, and a compressor 8 mounted on the bottom 9. Inlet ports 1*a* for introducing air into the interior of the cabinet are formed at opposite sides of the outdoor portion 11 of the cabinet 1.

In the room air conditioner constructed as aforesaid, the fan motor 5 and the compressor 8 are actuated, so that a refrigerant compressed in the compressor 8 has its temperature raised. The heated refrigerant is supplied to the outdoor heat exchanger 7 and cooled by a stream of air B produced by the rotation of the propeller fan 6. Then the cooled refrigerant is supplied to the indoor heat exchanger 2 where the refrigerant is expanded to cool the indoor heat exchanger 2, so that a stream of air A produced by the rotation of the Silocco fan 3 is cooled by the heat exchanger 2. The refrigerant is thereafter returned to the compressor.

Some disadvantages are associated with the room air conditioner of the prior art constructed as aforementioned. They include the following:

a. The arrangement in which the indoor heat exchanger 2, Silocco fan 3, fan motor 5, propeller fan 6 and outdoor heat exchanger 7 are disposed axially of the rotary shaft 5*a* of the fan motor or horizontally from the indoor portion to the outdoor portion of the cabinet makes it impossible to reduce the thickness T of the cabinet 1. This makes it impossible to obtain a compact overall size in a room air conditioner of the vertical type.

b. Since the outdoor air inlet ports l*a* are formed at the opposite sides of the cabinet 1, there is the possibility of the inlet ports 1*a* being closed by walls of the building in which the room air conditioner is to be installed. Where there is a hand rail or other obstacles on the outdoor side of the position in which the room air conditioner is to be installed, the outdoor air inlet ports 1*a* may be disposed within the room because the room air conditioner should be mounted in such a manner that it projects into the inside of the room. Thus limitations are placed on the position in which the air conditioner is installed.

c. A larger volume of air must be supplied to the outdoor heat exchanger 7 than to the indoor heat exchanger 2. This makes it necessary to increase the dimensions of the propeller fan 6. Because of this, the cabinet 1 must have a widthwise dimension which is larger than the outer diameter of the propeller fan 6, thereby making it impossible to obtain a compact overall size in a room air conditioner of the vertical type.

d. The Silocco fan 3 is arranged such that the stream of air delivered thereby in a tangential direction first strikes the top of the casing 1. Thus the stream of air of high speed delivered by the centrifugal fan 3 impinges on the ceiling of the cabinet 1, and is supplied to the room after changing its direction of flow substantially at right angles to the original stream from the fan 3. A large resistance is offered to the flow of the air at the point where the stream of the air changes its direction of flow. This makes it imperative to increase the power of the centrifugal fan 3, and thus a great deal of noise is produced by the fan.

SUMMARY OF THE INVENTION

An object of this invention is to provide a room air conditioner which enables its thickness to be greatly reduced.

Another object of the invention is to provide a room air conditioner which greatly relaxes limitations placed on the position in which the room air conditioner is installed.

Still another object of the invention is to provide a room air conditioner wherein streams of air of high speed delivered by the centrifugal fans located in both the indoor and outdoor portions of the cabinet can flow without being forced to change their direction of flow, whereby a reduction in resistance to the flow of air can lead to a lessening of noise produced by the streams of air and to a larger volume of air delivered than by the fans of a conventional room air conditioner.

The aforementioned objects of the invention are accomplished by mounting the fan motor on the partition plate, which divides the interior of the cabinet into an indoor portion and an outdoor portion, in such a manner that the rotary shaft of the fan motor is disposed perpendicular to the base of the cabinet, and by arranging the indoor and outdoor heat exchangers, fan motor and fans in such a manner that these parts are arranged in a vertical direction, not in a horizontal direction, in the cabinet. More specifically, a non-vertical section is provided in the partition plate; the fan motor is secured to the partition plate such that it is disposed in the outdoor portion, and one end portion of the rotary shaft of the fan motor penetrates the non-vertical section of the partition plate to extend into the indoor portion; a centrifugal fan is supported on either end of the rotary shaft of the fan motor; each centrifugal fan is provided with a spiral casing which has an outlet port opening in the front surface or rear surface of the cabinet; and the rotation of the centrifugal fans causes streams of air to pass through the indoor and outdoor heat exchangers and to be exhausted through the outlet ports of the spiral casings.

The above and further objects and novel features of the invention will more fully appear from the following detailed description when the same is read in connection with the accompnaying drawings.

It is to be expressly understood, however, that the drawings are for purpose of illustration only and are not intended as a definition of the limits of the invention.

DETAILED DESCRIPTION OF THE PREFERRED EMBODIMENT

Figure 1:
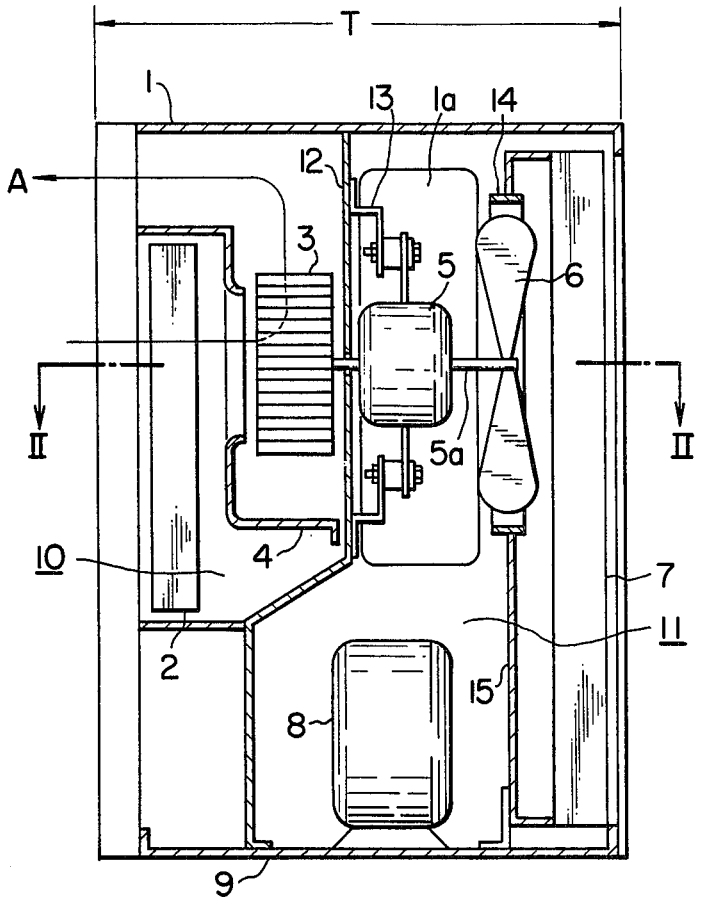
FIG. 1 PRIOR ART
FIG. 1 is a sectional side view schematically showing a vertical type room air conditioner of the prior art.
Figure 2:
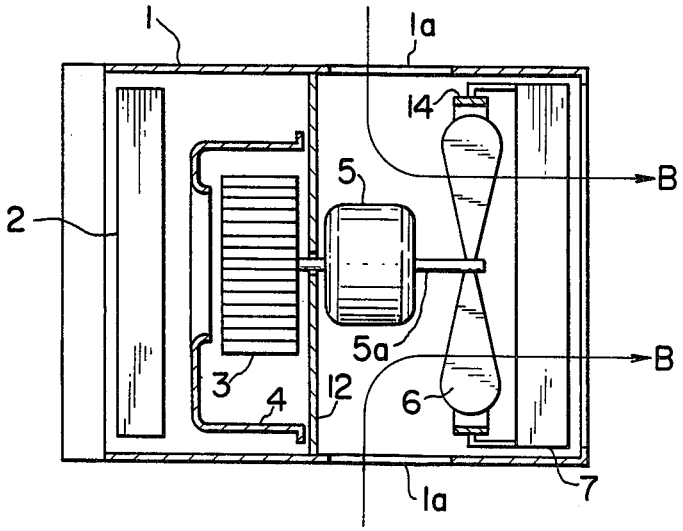
FIG. 2 PRIOR ART
FIG. 2 is a sectional view taken along the line II—II of FIG. 1.
Figure 3:
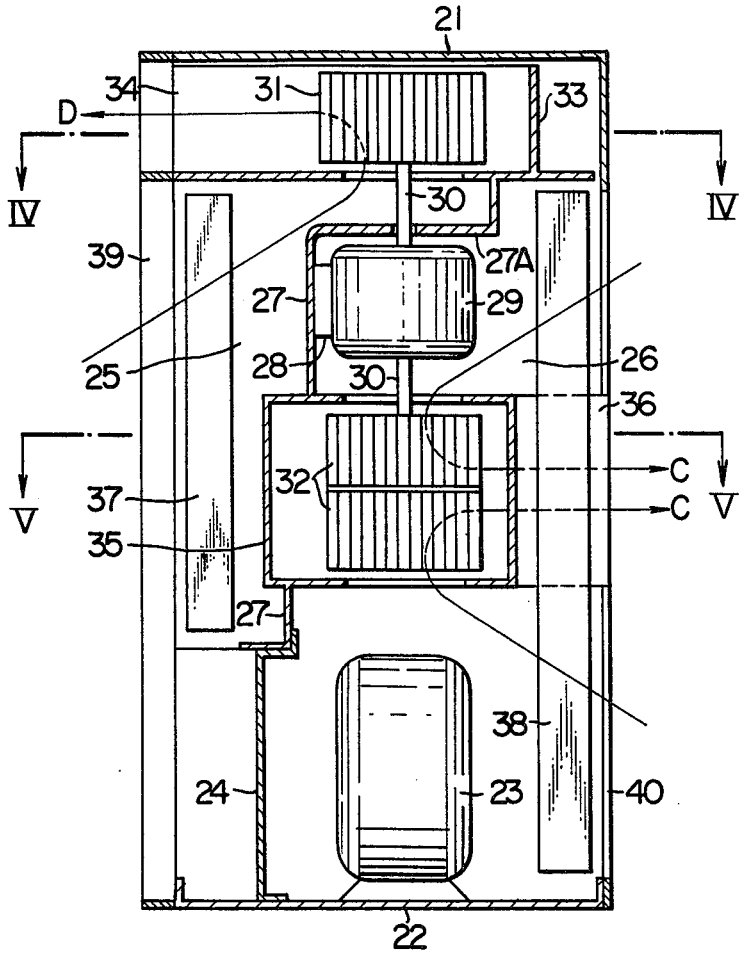
FIG. 3 is a sectional side view of the room air conditioner comprising one embodiment of the invention.
Figure 4:
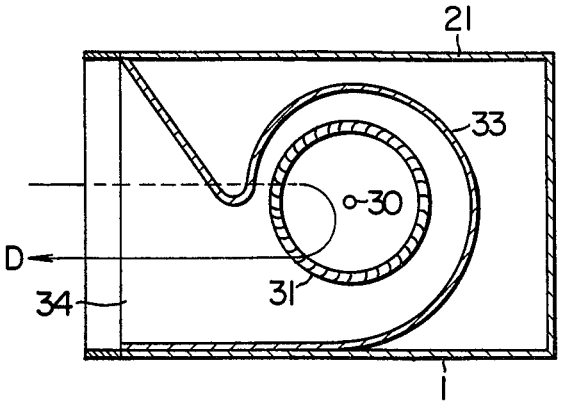
FIG. 4 is a sectional view taken along the line IV—IV of FIG. 3.
Figure 5:
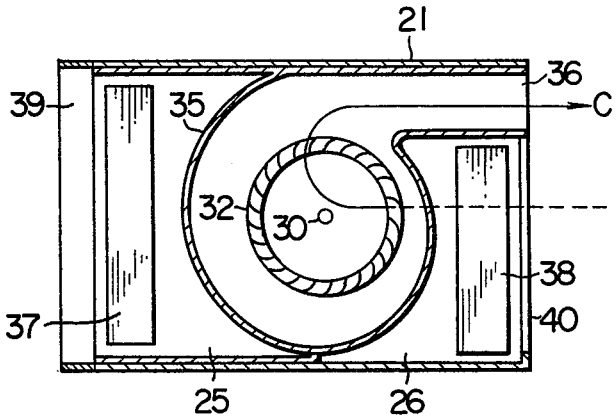
FIG. 5 is a sectional view taken along the line V—V of FIG. 3.

A preferred embodiment of the invention will now be described with reference to FIG. 3 to FIG. 5. As shown, a cabinet 21 included a bottom 22 on which a compresser 23 and a support 24 are secured. The support 24 supports thereon a partition plate 27 for dividing the interior of the cabinet 21 into an indoor portion 25 and an outdoor portion 26. Attached to a surface of the partition plate 27 facing the outdoor portion 26 is a mounting seat 28 which rigidly supports a fan motor 29 thereon in such a manner that a rotary shaft 30 of the fan motor 29 is disposed perpendicular to the bottom 22 of the cabinet. One end portion of the rotary shaft 30 penetrates a non-vertical section **27*a* of the partition plate 27 to extend into the indoor portion 25. A single suction Silocco fan 31 is mounted at one end of the rotary shaft 30 which is disposed in the indoor portion 25, while a double suction centrifugal fan 32 is mounted at the other end of the rotary shaft 30 which is disposed in the outdoor portion 26. Mounted around the single suction Silocco fan 31 is a spiral casing 33 which is supported by the partition plate 27 and includes an outlet port 34 opening in the inside of a room. The double suction Silocco fan 32 is surrounded by a spiral casing 35 which is supported by the partition plate 27 and is formed with an outlet port 36 provided in the rear of the cabinet 21** to open in the outside of the room.

An indoor heat exchanger 37 is supported by support means (not shown) secured to the bottom 22 of the cabinet and disposed in the front of the indoor portion 25, while an outdoor heat exchanger 38 is supported by support means (not shown) secured to the bottom 22 of the cabinet 21 and disposed in the outdoor portion of the cabinet 21. An indoor suction opening 39 is formed in the indoor portion 25 of the cabinet in such a manner that it is disposed in spaced juxtaposed relation to the indoor heat exchanger 37. An outdoor suction opening 40 is formed in the rear of the cabinet and in the outdoor portion 26 in such a manner that it is disposed in spaced juxtaposed relation to the outdoor heat exchanger 40. In the aforesaid construction, portions of the spiral casings 33 and 35 are utilized as sections of the partition plate 27. The refrigerant is supplied from the compressor 23 to the outdoor heat exchanger 36, from which it is transferred to the indoor heat exchanger 37 and returned to the compressor 23.

In the room air conditioner constructed as aforesaid, actuation of the compressor 23 and the fan motor 29 causes the refrigerant compressed in the compressor 23 to be supplied to the outdoor heat exchanger 38. Meanwhile, rotation of the fan motor 29 results in the double suction centrifugal fan 32 rotating, thereby exhausting the air in the outdoor portion 26 of the cabinet 21 through the outlet port 36 of the spiral casing 35. As a result, a negative or subatmospheric pressure prevails in the outdoor portion 26, so that the outdoor air is drawn by suction through the suction opening 40 and caused to pass through the outdoor heat exchanger 38 (see a stream of air C). Thus, the refrigerant which is heated by being compressed in the compressor 23 is cooled at the outdoor heat exchanger 38. The refrigerant, which is transferred from the outdoor heat exchanger 38 to the indoor heat exchanger 37, is expanded and cools the indoor heat exchanger 37. Meanwhile, rotation of the fan motor 29 causes the single suction Silocco fan 31 to rotate, thereby exhausting the air in the indoor portion 25 of the cabinet 21 through the outlet port 34 of the spiral casing 33. As a result, a subatmospheric pressure prevails in the indoor portion 25 of the cabinet 21, so that the air inside the room is drawn by suction through the suction opening 39 and caused to pass through the indoor heat exchanger 37 (see a stream of air D). At this time, the air drawn by suction is cooled by being brought into contact with the cooled indoor heat exchanger 37, and the cooled air is exhausted into the room again through the outlet port 34 of the spiral casing 33 by means of the single suction Silocco fan 31.

Figure 6:
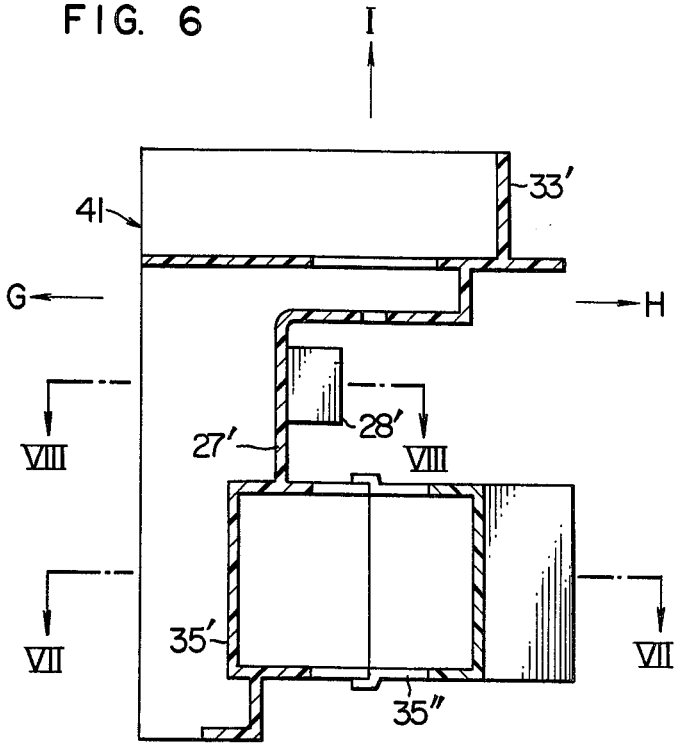
FIG. 6 is a sectional side view of the unitary structure used in the room air conditioner according to the invention.
Figure 7:
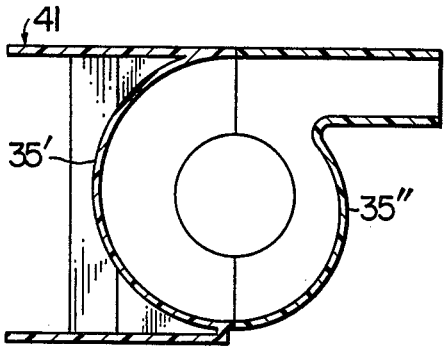
FIG. 7 is a sectional view taken along the line VII—VII of FIG. 6.
Figure 8:
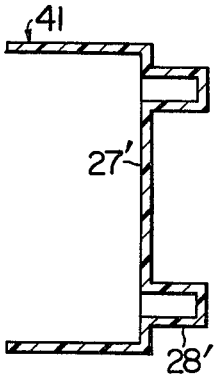
FIG. 8 is a sectional view taken along the line VIII—VIII of FIG. 6.

FIG. 6 to FIG. 8 show one form of the partition plate used in the embodiment described hereinabove. As shown, a partition plate section 27', a mounting seat 28', a spiral casing 33' and a portion of a spiral casing 35' are fabricated as a unit to provide the partition plate 41, and the other portion 35'' of the spiral casing 35' is formed as a separate entity which is connected to the partition plate 41 when the room air conditioner is assembled, in order that a blower unit consisting of a fan motor and centrifugal fans may be constructed as a unitary structure which can be detachably mounted in the room air conditioner. The plastic plate 41 may be produced by casting a plastic material in a mold as a unit. The mold used for casting the partition plate 41 has only to be opened and closed in the directions of arrows G, H and I in FIG. 6 after a plastic material is charged into the mold and the charge has set.

In mounting the fan motor 29 on the mounting seat 28', the former may be mounted on the latter either directly or through a vibration damping member, if necessary.

We claim:

1. A room air conditioner comprising:

a cabinet formed in its front facing the inside of a room with a suction opening and an outlet port for indoor air and at its rear facing the outside of the room with a suction opening and an outlet port for outdoor air;

a partition plate dividing the interior of said cabinet into an indoor space and an outdoor space and including at least one surface which is not perpendicular to a bottom of said cabinet;

a first heat exchanger mounted in said indoor space of said cabinet and disposed in spaced juxtaposed relation to said suction opening for indoor air;

a second heat exchanger mounted in said outdoor space of said cabinet and disposed in spaced juxtaposed relation to said suction opening for outdoor air;

a fan motor arranged in said outdoor space of said cabinet and supported by said partition plate in such a manner that its output shaft is disposed perpendicular to the bottom of said cabinet, said output shaft having one end portion penetrating said non-perpendicular surface of said partition plate to extend into said indoor space and the other end portion located within said outdoor space;

a first centrifugal fan of the single suction type supported by said one end portion of said output shaft of said fan motor extending into said indoor space;

a second centrifugal fan of the double suction type supported by said the other end portion of said output shaft of said fan motor located within said outdoor space;

a compressor supported on the bottom of said cabinet in said outdoor space of said cabinet and located in a manner to face an end face of said second centrifugal fan;

a first spiral casing mounted in said indoor space of said cabinet in a manner to enclose an outer peripheral portion of said first centrifugal fan and communicate with said outlet port for indoor air, said first spiral casing being operative to lead indoor air tangentially of said first centrifugal fan to be exhausted through said outlet port in said cabinet into the inside of the room after said indoor air is sucked through said indoor air suction opening, cooled by said first heat exchanger, introduced into said indoor space, sucked by said first centrifugal fan discharged from said first centrifugal fan; and a second spiral casing mounted in said outdoor space of said cabinet in a manner to enclose an outer peripheral portion of said second centrifugal fan and communicate with said outlet port for outdoor air, said second spiral casing being operative to lead outdoor air tangentially of said second centrifugal fan to be exhausted through said outlet port in said cabinet to the outside of the room after said outdoor air is sucked through said outdoor air suction opening and said second heat exchanger to cool said second heat exchanger, introduced into said outdoor space to cool said compressor and said fan motor, sucked by said second centrifugal fan, and discharged from said second centrifugal fan.

2. A room air conditioner comprising:

a cabinet formed with a suction opening and an outlet port for indoor air in an indoor portion thereof and a suction opening and an outlet port for outdoor air in a outdoor portion thereof;

a partition member located in the cabinet for dividing the interior of the cabinet into said indoor portion and said outdoor portion including at least one section which is not perpendicular to the bottom of the cabinet;

a first heat exchanger mounted in said indoor portion of the cabinet in communication with the suction opening for indoor air;

a second heat exchanger mounted in said outdoor portion of the cabinet in communication with the suction opening for outdoor air;

a fan motor mounted in the cabinet and located such that its output shaft is disposed perpendicular to the bottom of the cabinet and penetrates the non-perpendicular section of the partition member so that one end portion of the shaft is located within the indoor portion of the cabinet and the other end portion is located within the outdoor portion;

a first centrifugal fan supported at the one end portion of the output shaft of the fan motor extending into the indoor portion of the cabinet;

a second centrifugal fan supported at the other end portion of the output shaft of the fan motor extending into the outdoor portion of the cabinet; and guide means for dividing the indoor portion and the outdoor portion of the cabinet into a suction side and an exhaust side for the respective centrifugal fans such that said centrifugal fans operate to draw air by suction through the respective suction openings and the respective heat exchangers to the centrifugal fans and thereafter to exhaust the air directly to the respective outlet ports where it is exhausted therefrom.

3. A room air conditioner as claimed in claim 2, wherein said guide means comprises a first spiral casing and a second spiral casing supported in the cabinet for housing therein said first centrifugal fan and said second centrifugal fan disposed in the indoor portion and the outdoor portion respectively, each of said first spiral casing and said second spiral casing being formed with a suction opening corresponding in position to the suction port of each of said first centrifugral fan and said second centrifugal fan and with an exhaust opening extending in the tangential direction of an outer periphery of each said centrifugal fan and reaching the respective outlet port in the cabinet.

4. A room air conditioner as claimed in claim 3, wherein said first spiral casing and a portion of said second spiral casing are formed integrally with the partition member.

5. A room air conditioner as claimed in claim 2, wherein the first centrifugal fan disposed in the indoor portion is a single suction fan and the second centrifugal fan disposed in the outdoor portion is a double suction fan.

6. A room air conditioner as claimed in claim 2, wherein the suction opening and outlet port for indoor air are formed in the front of the indoor portion of the cabinet and the suction opening and outlet port for outdoor air are formed in the rear of the outdoor portion of the cabinet.

7. A room air conditioner as claimed in claim 2, wherein said fan motor is located with said outdoor portion of the cabinet and a compressor is located in said outdoor portion of the cabinet so as to face an end face of said second centrifugal fan, said fan motor and said compressor being cooled by the outdoor air being sucked to said second centrifugal fan.

* * * * *